US011319200B1

(12) United States Patent
Olson et al.

(10) Patent No.: US 11,319,200 B1
(45) Date of Patent: May 3, 2022

(54) COUNTER-PRESSURE FILLER

(71) Applicants: Paul A. Olson, Mora, MN (US); Donald W. Olson, Mora, MN (US); Eric D. Olson, Mora, MN (US)

(72) Inventors: Paul A. Olson, Mora, MN (US); Donald W. Olson, Mora, MN (US); Eric D. Olson, Mora, MN (US)

( * ) Notice: Subject to any disclaimer, the term of this patent is extended or adjusted under 35 U.S.C. 154(b) by 0 days.

(21) Appl. No.: 16/984,139

(22) Filed: Aug. 3, 2020

Related U.S. Application Data

(60) Provisional application No. 62/842,591, filed on May 3, 2019.

(51) Int. Cl.

| | |
|---|---|
| ***B67C 3/06*** | (2006.01) |
| ***B67C 3/02*** | (2006.01) |
| ***B67C 7/00*** | (2006.01) |
| ***B67C 3/26*** | (2006.01) |

(52) U.S. Cl.
CPC ..... *B67C 3/06* (2013.01); *B67C 3/023* (2013.01); *B67C 3/2614* (2013.01); *B67C 7/00* (2013.01); *B67C 2003/2657* (2013.01)

(58) Field of Classification Search
CPC ..... B67C 3/06; B67C 3/2614; B67C 7/00; B67C 2003/2657
USPC ..... 141/20, 57
See application file for complete search history.

(56) References Cited

U.S. PATENT DOCUMENTS

| | | | | |
|---|---|---|---|---|
| 2,519,353 | A * | 8/1950 | Cassady | B65B 31/00 53/110 |
| 2,661,134 | A * | 12/1953 | McGihon | B67C 7/0046 53/276 |
| 3,486,295 | A * | 12/1969 | Tuma | B65B 31/02 53/89 |
| 4,254,152 | A * | 3/1981 | Janovtchik | A23L 3/10 426/399 |
| 5,230,203 | A * | 7/1993 | Wu | B67C 7/00 141/258 |
| 5,961,000 | A * | 10/1999 | Sanfilippo | B65B 31/00 141/47 |
| 6,105,341 | A * | 8/2000 | Campbell | B21D 51/32 413/27 |
| 6,202,388 | B1 * | 3/2001 | Sanfilippo | B65B 31/028 53/432 |
| 8,820,366 | B2 * | 9/2014 | Krulitsch | B67C 3/26 141/371 |
| 2018/0222739 | A1 * | 8/2018 | Brey | B67C 3/262 |

* cited by examiner

*Primary Examiner* — Timothy L Maust
(74) *Attorney, Agent, or Firm* — Underwood & Associates, LLC

(57) ABSTRACT

A counter-pressure filler system includes a vertically-translatable platform capable of supporting a container, a pressurizable chamber having an entrance aperture, the chamber enclosing a seaming chuck and at least one seaming roller, a vertically-translatable enclosure comprising an upper portion configured to engage a portion of said chamber around the entrance aperture, thereby creating a pressurizable atmosphere within said vertically-translatable enclosure and the pressurizable chamber. The seaming chuck is configured to allow a beverage ingredient to pass therethrough and into said container.

20 Claims, 16 Drawing Sheets

Detail A

COUNTER-PRESSURE FILLER

CROSS REFERENCE TO RELATED APPLICATIONS

This application claims priority to and the benefit under 35 USC § 119(e) of U.S. Provisional Patent Application No. 62/842,591, filed on May 3, 2019 and entitled "Counter-Pressure Filler", the contents of which are incorporated by reference in their entirety as if fully set forth herein.

TECHNICAL FIELD

This disclosure relates to systems and methods for filling containers. In particular, this disclosure relates to filling containers with a carbonated beverage and capping the container with a lid.

BACKGROUND

Carbonated beverages are typically bottled or canned in a sturdy, leak-proof container to prevent carbon dioxide or other gases from escaping and making the beverage go flat. Typically, carbonated beverages such as sodas, beer and others are packaged in cans formed from aluminum or steel, or bottles.

The process of filling and capping carbonated beverages can present challenges in maintaining desired carbonation levels and preventing foaming. Dissolved carbon dioxide can escape a liquid if the partial pressure above the liquid changes, according to Henry's Law. The same can also happen if a liquid containing dissolved gas suddenly changes.

A common way to carbonate beer, for example, is to subject a volume of un-carbonated beer, or 'wort' to a pressurized volume of carbon dioxide gas. Over time, carbon dioxide is dissolved into the wort, creating carbonized beer. The amount of carbonation can be controlled by several factors, including the temperature of the wort, the pressure of the carbon dioxide atmosphere and the amount of time the wort is subjected to the carbon dioxide atmosphere.

The process of transferring carbonated wort to a canning or bottling station can subject the carbonated solution to pressure and temperature changes which can introduce unwanted foaming. Thus, a system and process for canning and bottling carbonated beverages such as beer under pressure, without introducing pressure changes to the liquid is an unmet need in the canning and bottling arts.

SUMMARY

In general, a counter-pressure filler system is described. In one exemplary embodiment, the counter-pressure filler system includes a vertically-translatable platform capable of supporting a container, a pressurizable chamber having an entrance aperture, the chamber enclosing a seaming chuck and at least one seaming roller, a vertically-translatable enclosure comprising an upper portion configured to engage a portion of the chamber around the entrance aperture, thereby creating a pressurizable atmosphere within said vertically-translatable enclosure and the pressurizable chamber. The seaming chuck is configured to allow a beverage ingredient to pass therethrough and into said container.

In one aspect, a counter-pressure filler system (hereinafter 'system') is described. The system includes a chamber having an entrance aperture, the chamber surrounding a seaming chuck and at least one seaming roller, a vertically-translatable enclosure comprising an open upper rim configured to engage a portion of the chamber around the entrance aperture, thereby creating a shared, sealed environment within the vertically-translatable enclosure and the chamber. The system further includes a vertically-translatable platform configured to support a container thereupon that is disposed within the vertically-translatable enclosure, and a dispenser configured to dispense one or more ingredients into the container.

In one embodiment, the dispenser is configured to pass said one or more ingredients through the seaming chuck. In one embodiment, the system further includes a vacuum source configured to evacuate the sealed environment. In one embodiment, the sealed environment is configured to receive a gas or a gas mixture. In one embodiment, the sealed environment is configured to be subjected to a negative atmospheric pressure followed by being subjected to a positive atmospheric pressure that introduces a gas or gas mixture to the sealed environment. In one embodiment, the system further includes a swing arm configured to engage and controllably shift a lid, wherein the lid is configured to be seam-rolled onto said beverage container. In this embodiment, the swing arm is configured to engage the lid, shift the lid away from the beverage container prior to dispensing the ingredient; and shift the lid into a position to engage a top rim portion of the beverage container after the ingredient has been dispensed.

In one embodiment, the vertically-translatable platform is configured to rotate in a horizontal plane that is perpendicular to vertical translation.

In one embodiment, the seaming chuck and the seaming roller are configured to cooperatively seal a lid to the container. In this embodiment, the container is an aluminum can and the lid is configured to be mated to a top portion of the aluminum can.

In a second aspect, a method of counter-filling a beverage container is disclosed. The method includes placing an empty container atop a vertically-translatable platform, the empty container having an un-sealed lid resting thereupon, translating the vertically-translatable platform such that the empty container is at least partially translated into an aperture of a chamber comprising a seaming chuck and a seaming roller; and translating a vertically-translatable enclosure such that a top portion of the enclosure sealingly engages the aperture so as to create a shared, sealed environment comprising an interior of said chamber and an interior of the enclosure, wherein the enclosure encloses the vertically-translatable platform and the container.

In one embodiment, the method further includes evacuating the sealed environment by applying a vacuum.

In one embodiment, the method further includes adding a gas or a gas mixture to said sealed environment. In this embodiment, the method further includes, after the gas or said gas mixture has been added to said sealed environment, vertically translating the platform such that the lid is brought into proximity to a swing arm configured to engage the lid, engaging the lid with the swing arm, followed by pivotally rotating the swing arm such that the lid is translated away from the container, dispensing a quantity of liquid through the seaming chuck into the container, after the dispensing step, pivotally rotating the swing arm such that the lid is brought into position to be seam rolled to the container.

In a related embodiment, the method further includes vertically translating the platform such that the lid confronts the seaming chuck, activating the seaming chuck to cause rotation of the container and the lid, and applying the seaming roller to the lid to cause a seam to be formed between the lid and the container.

In one embodiment, the liquid is carbonated.

In one embodiment, the container is an aluminum can.

In one embodiment, the vertically-translatable platform is configured to rotate in a horizontal plane, perpendicular to a vertical translation direction.

In a third aspect, a counter-pressure filler includes a vertically-translatable platform configured to support a container, a vertically-translatable enclosure configured to surround the platform, the enclosure comprising an open top portion, a chamber comprising an entrance aperture, a seaming chuck and a seaming roller therewithin. The enclosure is configured to vertically translate to engage the chamber such that the open top surrounds the entrance aperture of the chamber, thereby creating a sealed filling environment comprising the interior of the chamber and the enclosure, and the atmosphere of the filling environment can be evacuated and subsequently pressurized with a gas or a gas mixture. Furthermore, the seaming chuck comprises a through-aperture for dispensing liquid into said container.

In one embodiment, the vertically-translatable platform is rotatable about a horizontal axis.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

Figure 1:
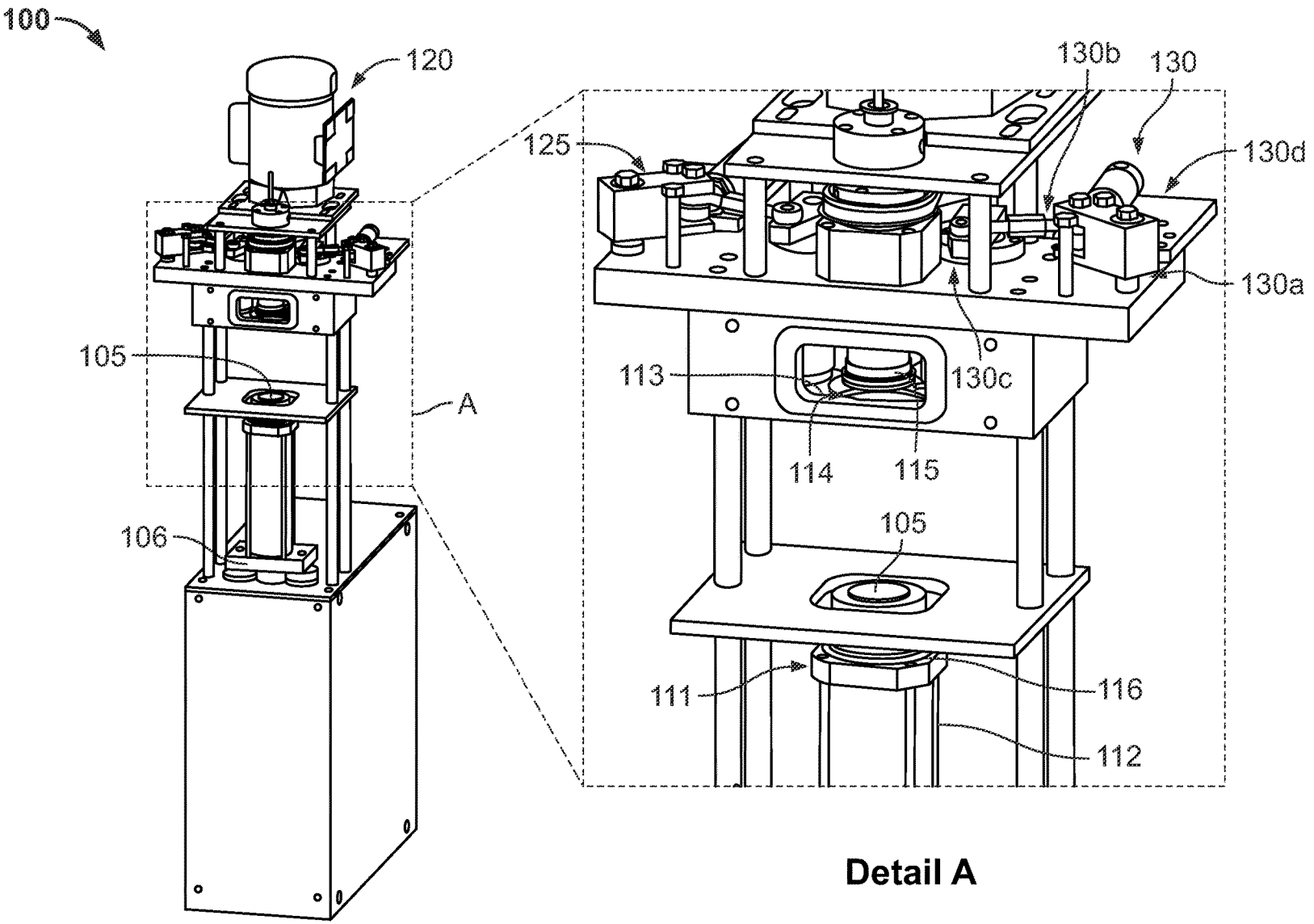
FIG. 1 illustrates a counter pressure filler according to one embodiment.

FIG. 1 shows a beverage counter-pressure filling system (hereinafter 'filling system') 100 according to one embodiment. In this embodiment, the filling system 100 includes a vertically-translatable platform 105 atop a vertically-translatable post 110 (see FIG. 4). The vertically-translatable post 110 is independently controllable to shift up and down (as viewed in the figures). The post 110 can be vertically translated by, e.g., a pneumatic piston driver, a series of linkages or any other suitable method, and can further be computer-controlled by logic functions. The vertically-translatable platform 105 is configured to receive an empty container which, in the exemplary description that follows is an aluminum can (see, e.g., FIG. 3). It should be understood, however, that other beverage container types can be substituted.

Referring to Detail A of FIG. 1, in this embodiment, the filling system 100 includes a vertically-translatable, cylindrical enclosure 112 (hereinafter 'cylinder 112') that is configured to shift independently of the vertically-translatable platform 105 and post 110. In this embodiment, briefly referring to FIG. 4, a bottom portion 107 of cylinder 112 is connected to a plate 106; plate 106, in turn, is connected to connecting rods 108, 109 which are connected to the linkages that drive the vertical translation of the plate 106. Vertical translation of the cylindrical enclosure can likewise be computer-controlled by logic functions.

When cylinder 112 is shifted vertically, a sealing gasket 116 on a top portion 111 of the cylinder 112 confronts the underside of wall 113 (the underside of wall 113 is not visible in FIG. 1). The bottom portion of cylinder 107 is sealed (see FIG. 4); thus, when cylinder 112 is shifted maximally upward, such that gasket 116 confronts the underside of wall 113, the interior of the cylinder 112 becomes atmospherically sealed. In this configuration, the cylinder 112 encloses platform 105 and the container placed thereupon in a sealed atmosphere. In an alternative embodiment, the sealing gasket 116 can be located on the underside of wall 113 instead of on the top portion of cylinder 112. It should be understood, however, that this alternative configuration also results in the same or similar sealed atmosphere.

By connecting a compressed gas or vacuum source to the cylinder 112, the sealed atmosphere within cylinder 112 can be controllably pressurizable or de-pressurizable, respectively. Cylinder 112 can be pressurized by a compressed gas source such as air, carbon dioxide, argon or other chosen gas. In this embodiment, the vertically-translatable post 110 and cylinder 112 are independently controllable by motors, actuators and pistons that engender controlled, independent vertical translation in upward and downward directions.

Figure 2:
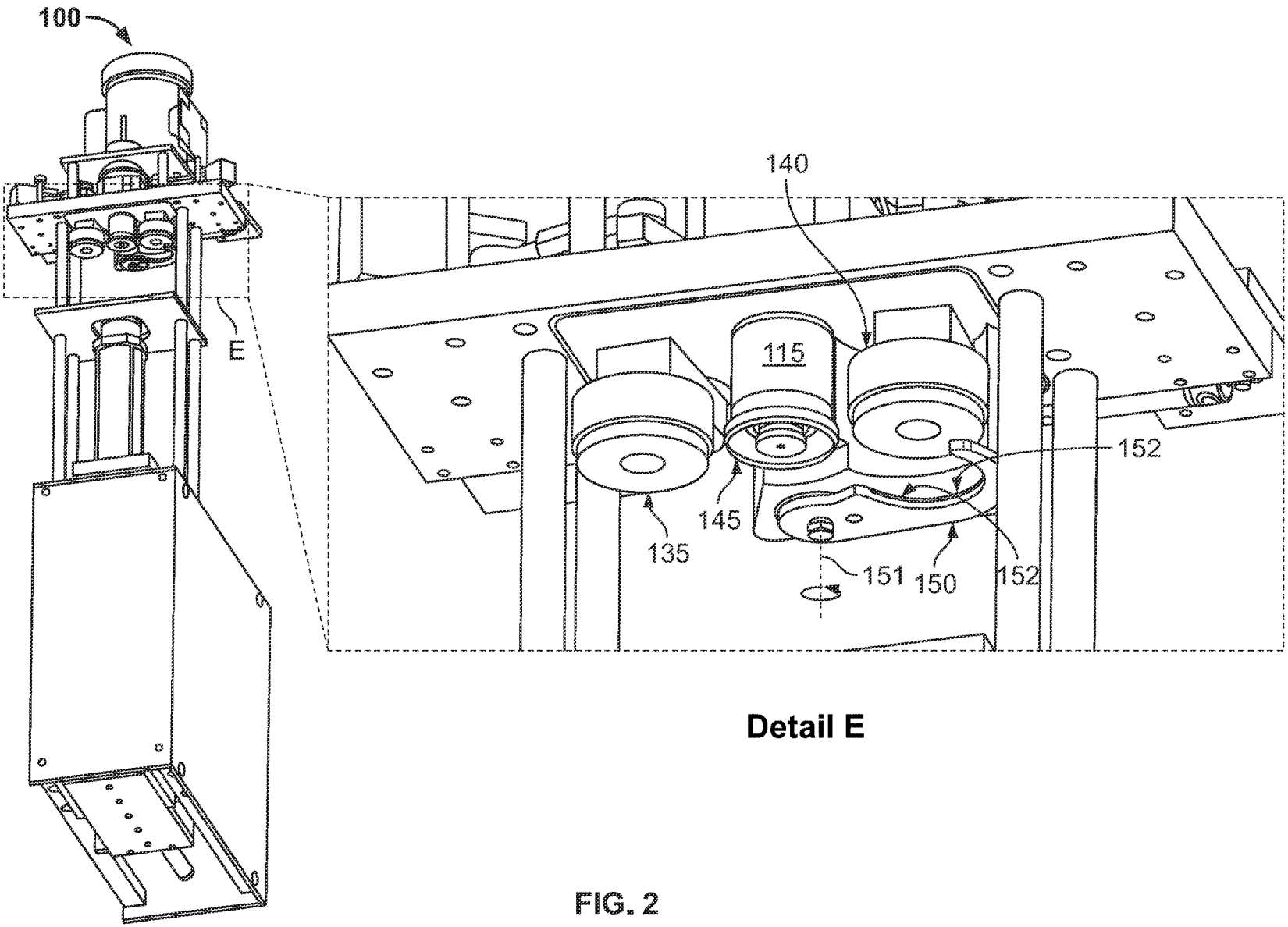
FIG. 2 shows the counter pressure filler of FIG. 1 from a bottom perspective view according to one embodiment.
Figure 3:
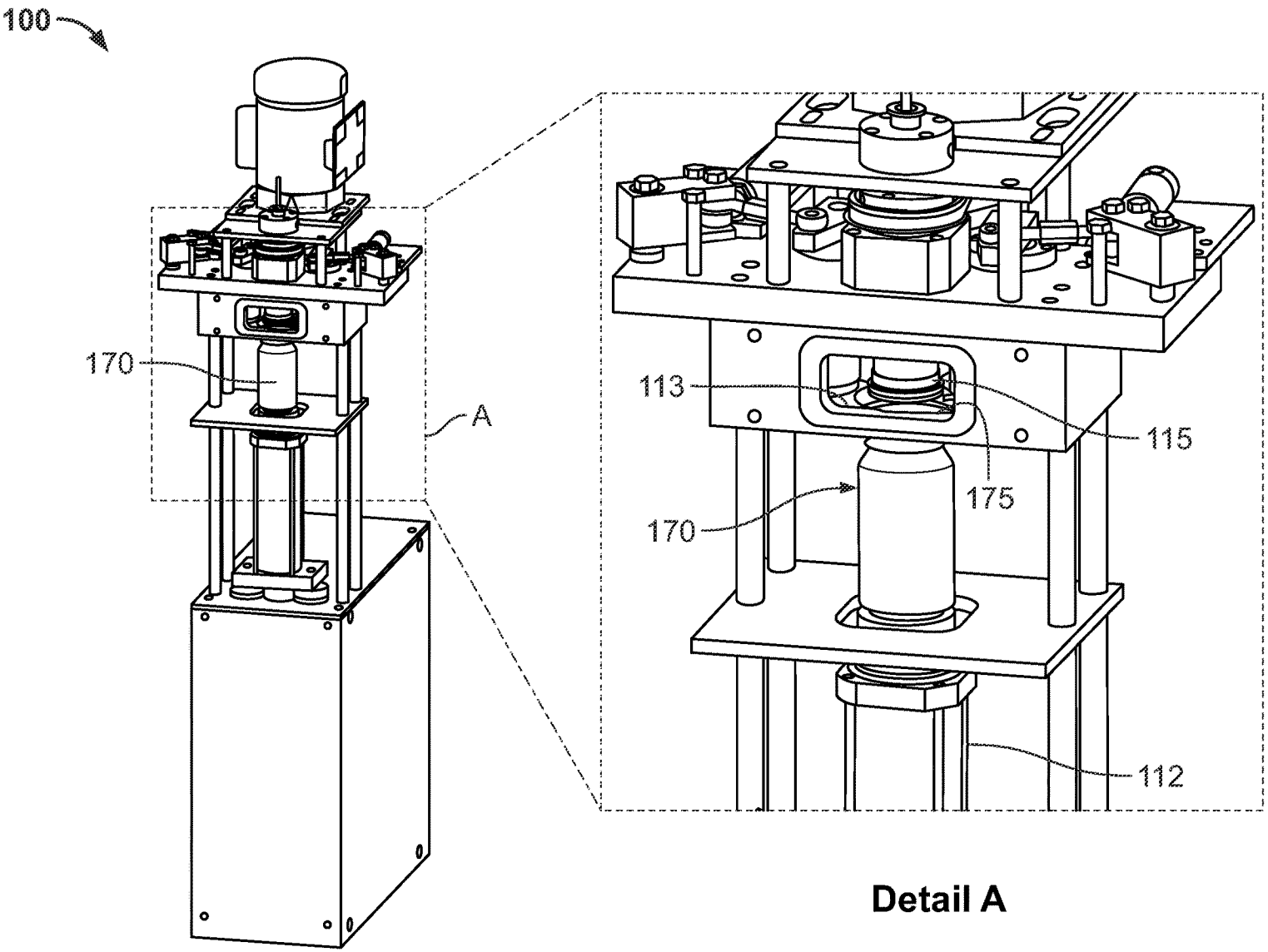
FIG. 3 illustrates placement of a container on the counter pressure filler of FIG. 1 according to one embodiment.
Figure 4:
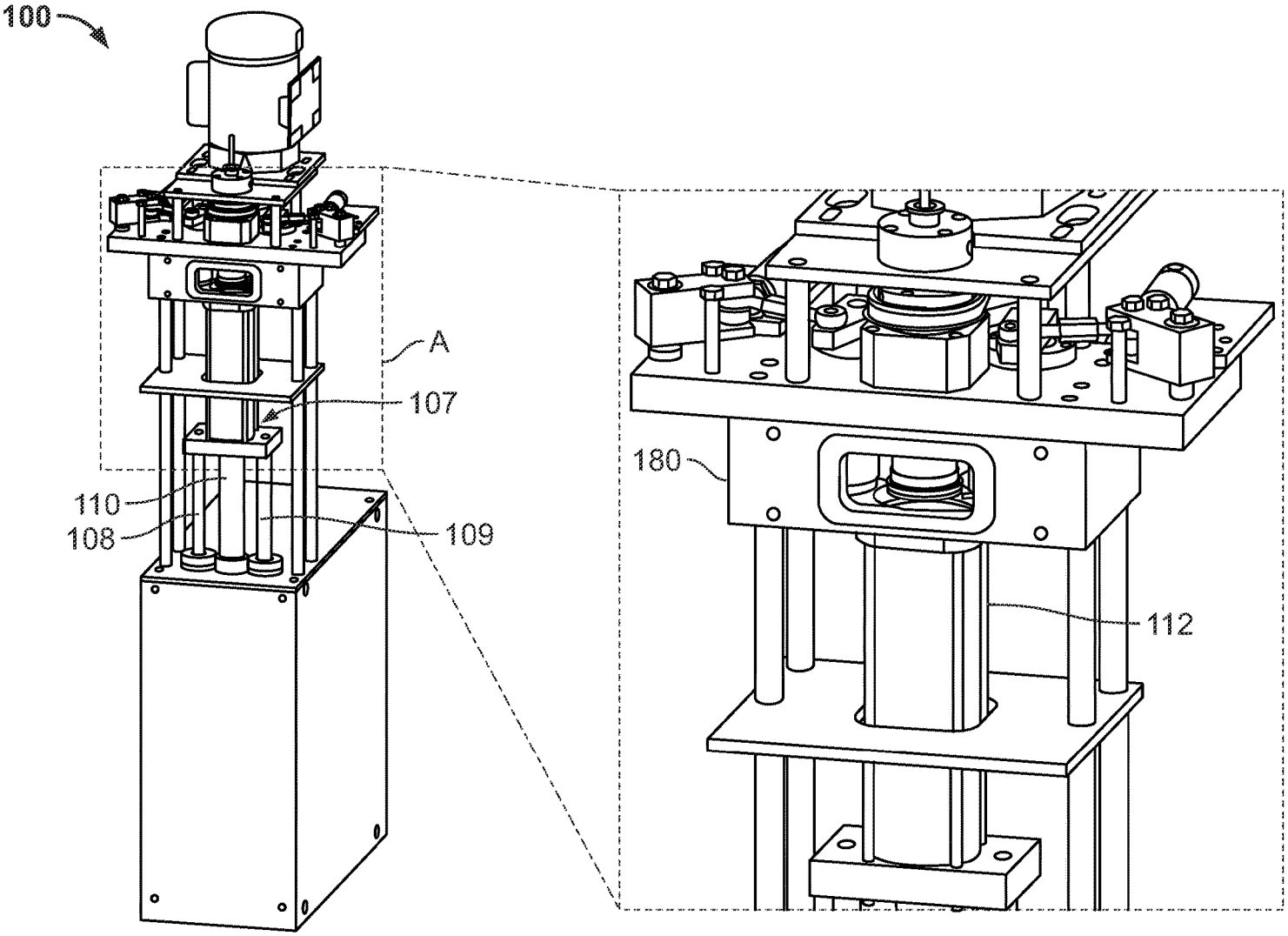
FIG. 4 illustrates vertical movement of a cylinder of the counter pressure filler of FIG.

Wall 113 is removed from the underside views, e.g., in FIG. 2 for clarity of the illustrations. However, FIGS. 1, 3 and 4 illustrate that wall 113 includes an aperture 114 through which a top portion of the container protrudes when platform 105 is shifted upward as described in greater detail below.

In this embodiment, the filling system 100 includes a rotatable seaming chuck 115. The seaming chuck 115 is configured to cooperate with first (135) and second (140) seaming rollers (FIG. 2) to permanently engage a lid to a beverage container by imparting a seam thereto as described in greater detail below. A seaming chuck motor 120 is configured to rotate the seaming chuck 115, which, as described in greater detail below, engenders the beverage container and lid to spin during the seaming process. First (125) and second (130) seam roller controller assemblies are configured to translate the first (135) and second (140) seaming rollers, respectively, into position during the seaming process as described in greater detail below. In this embodiment, each seam roller controller assembly includes, inter *alia*, a fixed pivot 130*a*, and a connecting link 130*b*, which connects to a crank arm 130*c*. An air cylinder 130*d* is configured to activate the crank arm 130*c* which, when pushed, drives motion of the seaming roller 140 via a shaft connected to an arm (not shown in FIG. 1 for clarity of the drawing). The first seam roller controller assembly 125 includes the same or similar components as the second seam roller controller assembly 130 but is not specifically highlighted in the figures for clarity of the drawings.

In this embodiment, the filling system 100 further includes a pivotable swing arm 150, which is pivotable about axis 151 as shown, and includes a C-shaped gripping portion 152 as shown. The swing arm 150 is configured to swing about axis 151 to bring the gripping portion 152 into confrontation with, and engage a beverage lid so as to move the beverage lid out of the way during filling and replace it for capping, as described in greater detail below. The swing arm 150 is controlled by a mechanical controller that engenders controllable pivoting of the swing arm back and forth as illustrated.

Each of the post 110, cylinder 112, pressurized gas control, swing arm controller, seaming chuck motor 120, first (125) and second (130) seam roller controller assemblies and other components and features can be logic-controlled to automate a beverage filling and canning process described herein.

Referring now to FIGS. 1-16, the filling system 100 and method of its use is further described according to one embodiment. The following description describes filling and capping of an aluminum can; however, other container types can be substituted according to preference, including, but not limited to plastic and aluminum containers utilizing screw tops and crimp-on style caps.

Referring first to FIGS. 1 and 2, in a ready configuration, the vertically-translatable platform 105 (hereinafter "platform 105") and cylinder 112 are in a fully-retracted configuration wherein platform 105 is maximally distanced from wall 113. Rotatable swing-arm 150 (FIG. 2), is similarly in a fully-retracted position, wherein the C-shaped grabbing portion 152 is maximally displaced from seaming chuck 115.

Next, referring to FIG. 3, an empty can 170 with a lid 175 (or, in an alternative embodiment, a bottle with a cap) is placed upon platform 105. The lid 175 is one that is configured to be permanently coupled to the can 170 by a seaming process.

Next, referring to FIG. 4, cylinder 112 is translated vertically. In this step, platform 105 is shifted vertically such that an upper portion of can 170 (with lid 175) passes through aperture 114 of wall 113 but stops prior to confronting seaming chuck 115. At the same time, cylinder 112 shifts upwardly such that gasket 116 engages the underside of wall 113. Wall 113 is integral with chamber 180; gasket 116 is configured to engage the underside of wall 113, thus, when gasket 116 confronts the underside of wall 113, cylinder 112 and chamber 180 share a sealed environment from the outside atmosphere.

Figure 5:
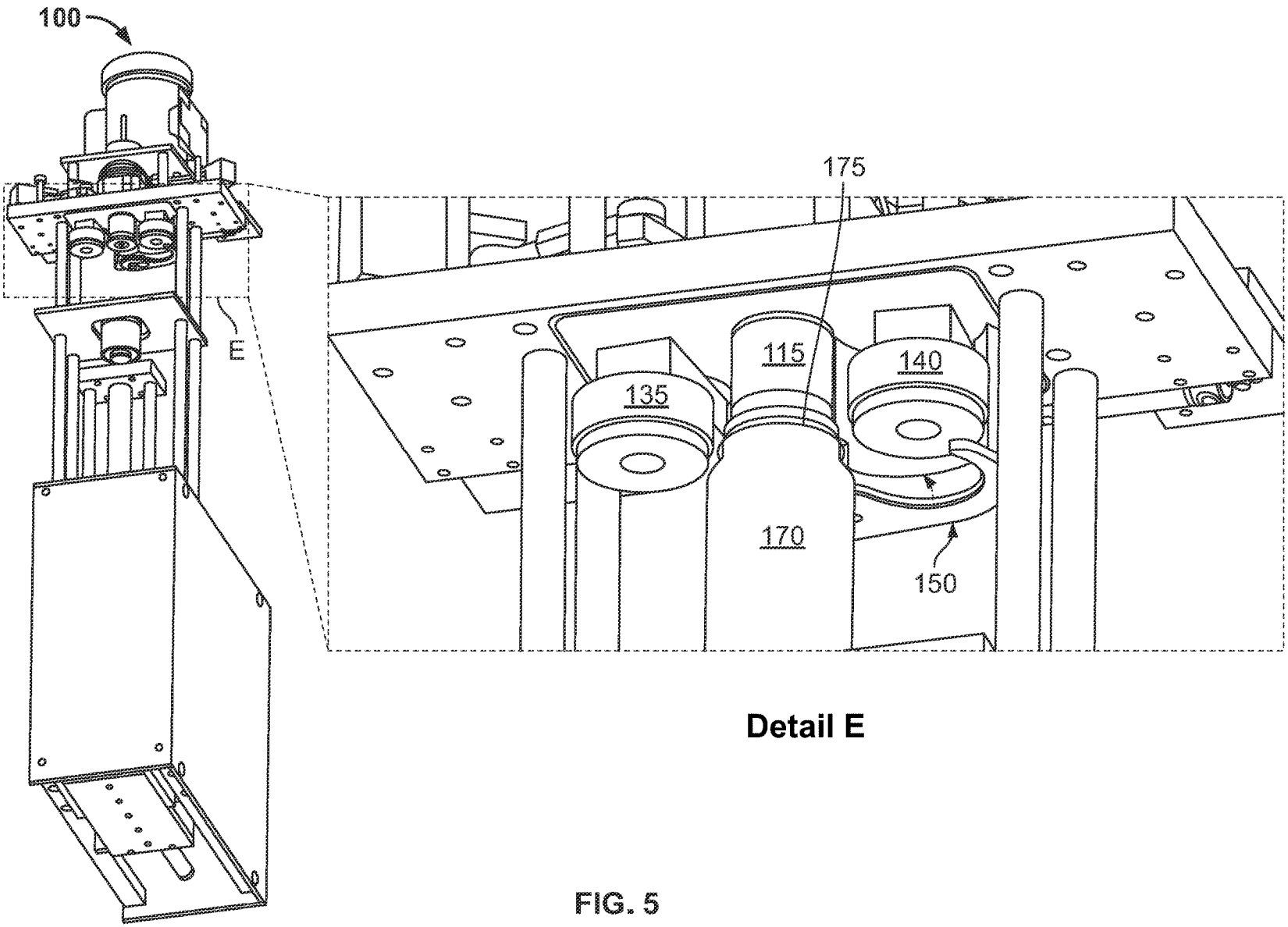
FIG. 5 is a magnified view of lid seaming components of the counter pressure filler of FIG. 1 according to one embodiment.
Figure 6:
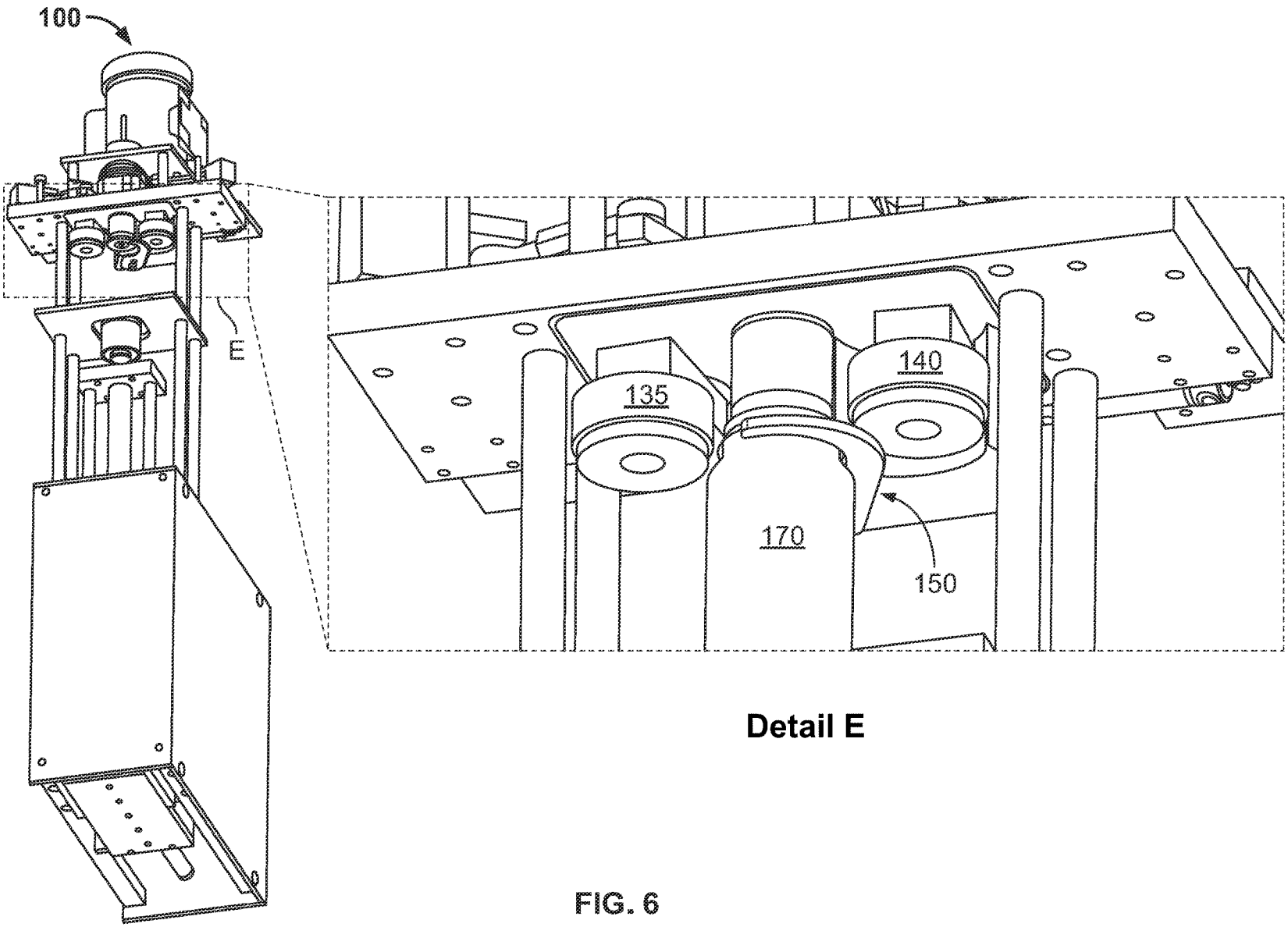
FIG. 6 illustrates motion of a swing arm member of the counter pressure filler of FIG. 1 according to one embodiment.

Next, referring to FIG. 5, swing arm 150 is shifted in the general direction of the dashed arrow so as to confront and engage lid 175. The curvature of the C-shaped gripping portion 152 is configured to be complimentary with the outer circumference of lid 175, such that the C-shaped gripping portion can grab and move lid 175 away from can 170. Swing arm 150 can grip lid 175 by any desired method, including lifting the lid 175 from underneath, by friction, suction, by urging the lid into a pocket of the swing arm or any other desired method. FIG. 6 illustrates swing arm 150 engaged with lid 175.

Figure 7:
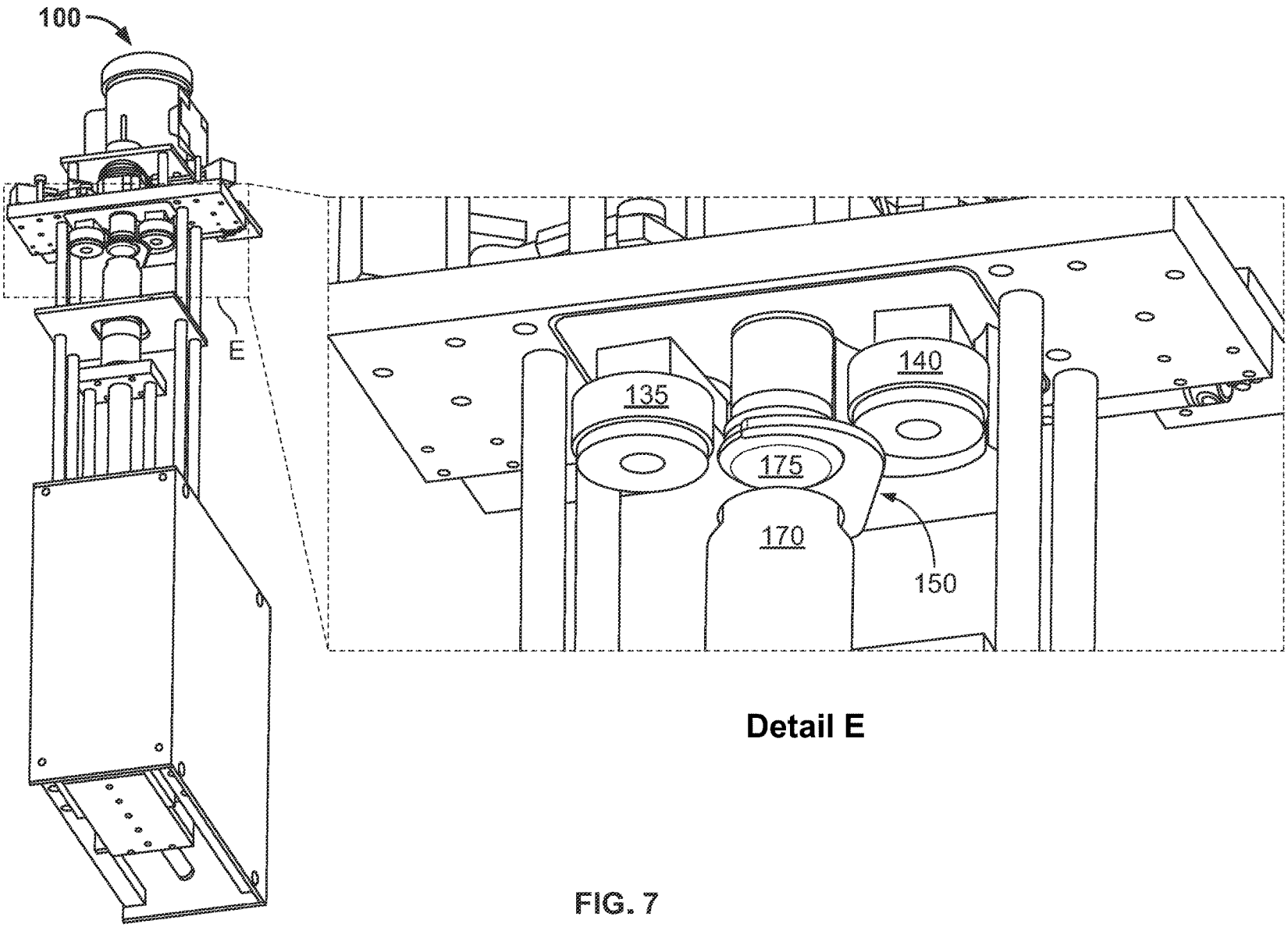
FIG. 7 illustrates vertical shifting of a beverage container during a filling process according to one embodiment.

Next, referring to FIG. 7, platform 105 is shifted downwardly, slightly, to allow swing arm 150 to clear the upper portion of the can 170. FIG. 7 illustrates lid 175 engaged with and held by swing arm 150. The atmosphere in chamber 180 and cylinder 112 can be simultaneously evacuated (placed under vacuum) or pressurized to a preferred atmospheric pressure. In this embodiment, at this point in the present example, a selected gas is introduced into chamber 180 and cylinder 112 to a desired atmospheric pressure.

Figure 8:
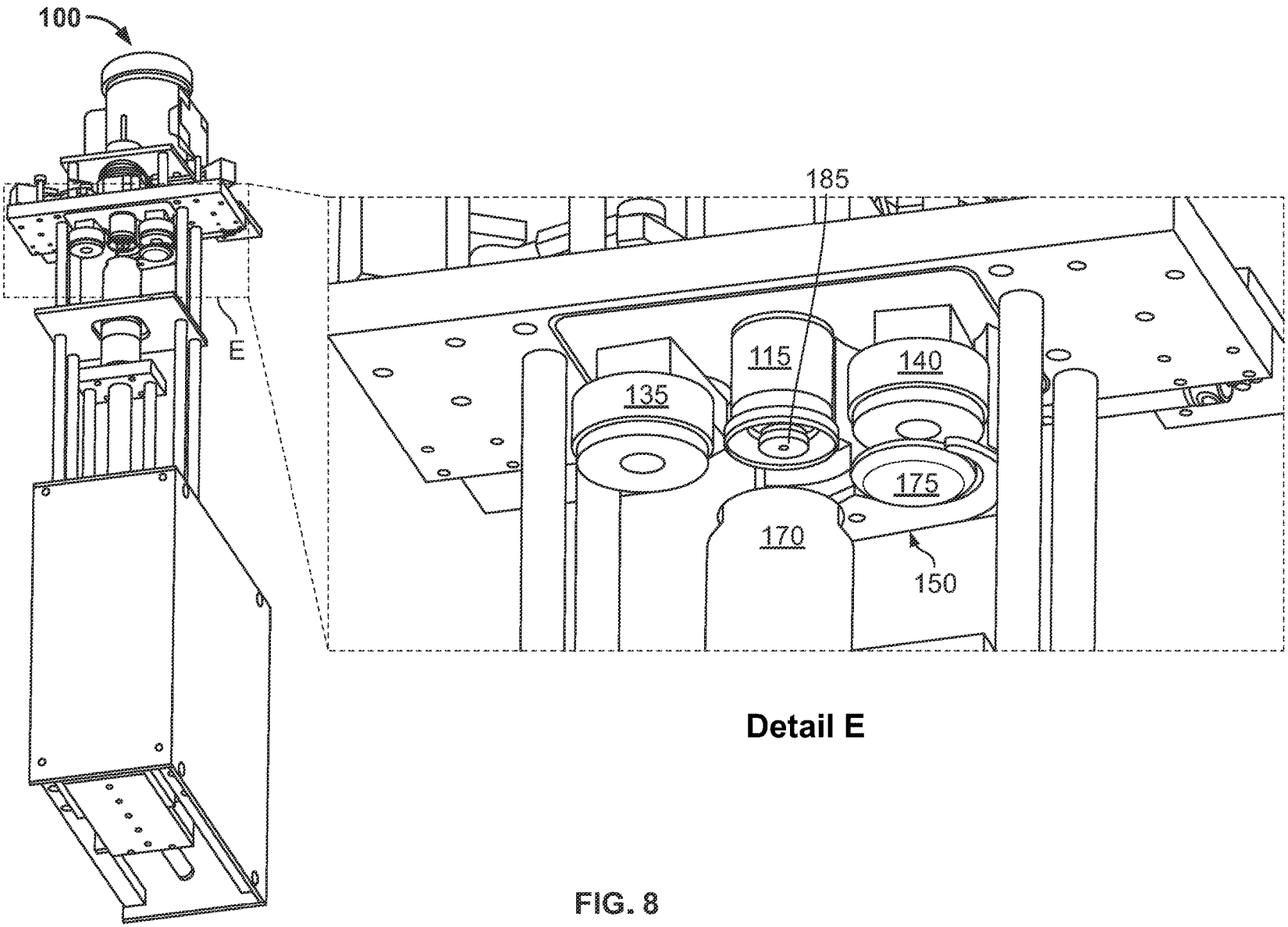
FIG. 8 illustrates swing arm and lid movement of the counter pressure filler of FIG. 1 according to one embodiment.

Next, referring to FIG. 8, swing arm 150 reverses to expose the upper portion of can 170 to filling nozzle 185 located within seaming chuck 105. In this embodiment, filling nozzle 185 is connected to a source, such as a vat or other container containing the liquid beverage that is intended for can 170. In this non-limiting example, the liquid beverage is beer; however, the liquid beverage can be soda, carbonated water or other spirits, or any other desired beverage, including non-carbonated beverages. Dispensing of the liquid beverage can be controlled, for example, by one or more logic controllers in signal communication with one or more pumps, such as a displacement pump that can deliver a selected volume of the liquid beverage, a flow meter, a pressurized staging tank with volume detecting sensors or a combination thereof.

Figure 9:
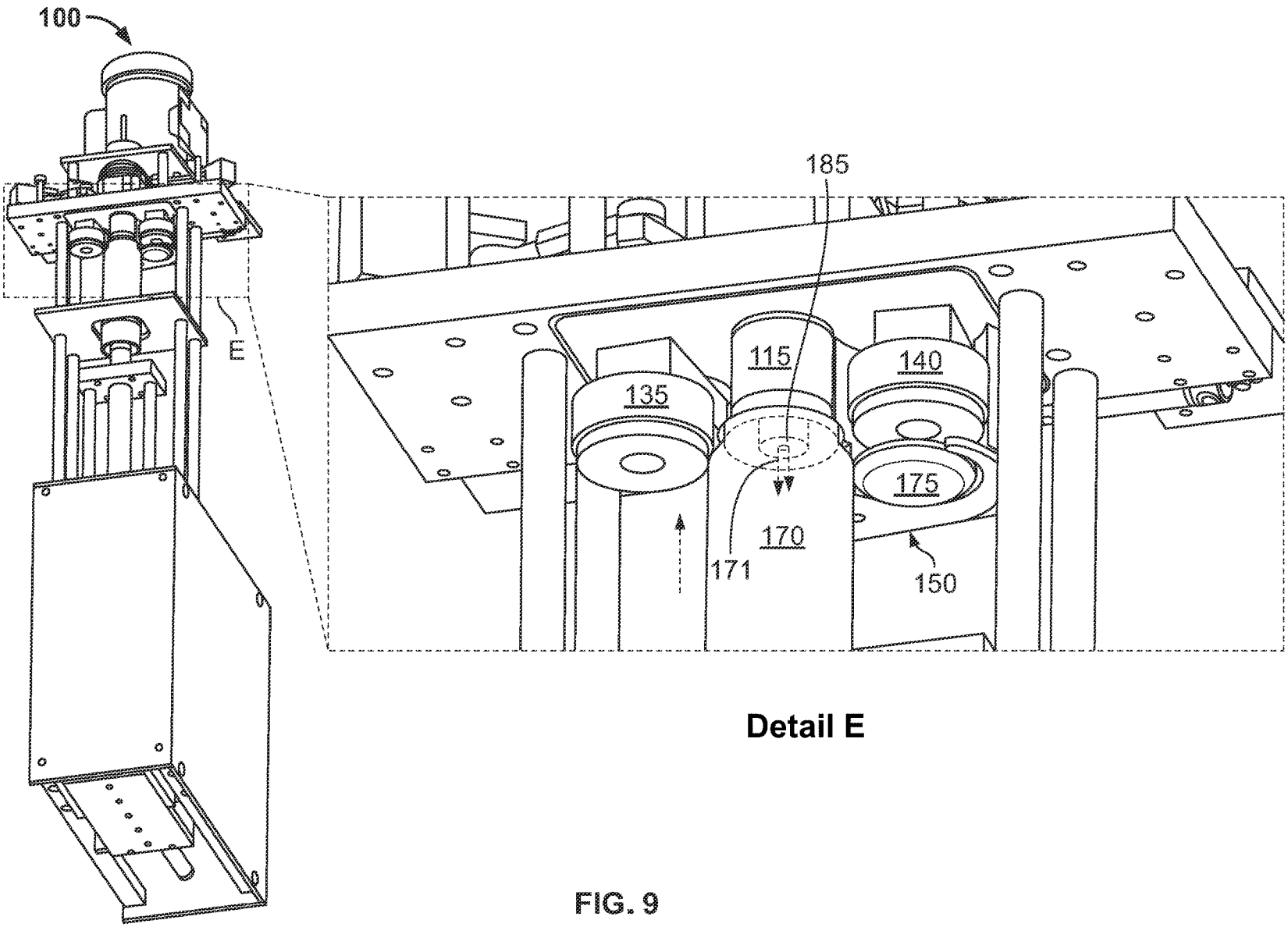
FIG. 9 illustrates a beverage container filling process according to one embodiment.

Next, referring to FIG. 9, platform 105 is shifted upward so that an upper portion of can 170 is proximal to filling nozzle 185, for example, so that the filling nozzle is slightly (e.g., 5-10 mm) within the upper portion of the can 170. Next, liquid contents (illustrated by downward arrows 171) are dispensed into can 170. In this example, chamber 180 and cylinder 112 are pressurized during the filling process, which significantly reduces foaming of the carbonated beer as it is dispensed into the can 170. In one example, the chamber 180 and cylinder 112 can be simultaneously pressurized to between about 13 and about 40 pounds per square inch. It should be understood that other pressures and pressure ranges may be selected according to preference or utility. In a preferred embodiment, chamber 180, cylinder 112 or both are in atmospheric communication with a pressurized gas or vacuum source respectively capable of rapidly pressurizing or de-pressurizing the filling environment rapidly, to increase the overall speed of the canning process.

In one embodiment, the combined atmosphere of chamber 180 and cylinder 112 can be evacuated under vacuum to purge oxygen from the filling environment. Next, a gas or gas mixture of choice, e.g., nitrogen or argon can be introduced into the filling environment, chamber 180 and cylinder 112, so that the canning process is completed under an atmosphere of choice, such as an inert gas. Such as process can greatly extend the shelf life of beer and other canned products by significantly reducing or eliminating oxygen from the canned product.

In one non-limiting example of a functioning filling system 100, the filling environment (chamber 180 and cylinder 112) was evacuated to about 23 inches of vacuum within about one-half second. Next, an atmosphere of carbon dioxide was introduced to re-pressurize the filling environment to a chosen pressure, e.g., standard atmospheric pressure. In this example, the resulting concentration of dissolved oxygen in beer canned by the present embodiment measured between 3-4 parts per billion, whereas dissolved oxygen concentrations in beer using industry-standard canning procedures is typically in the range of 80-100 parts per billion.

Figure 10:
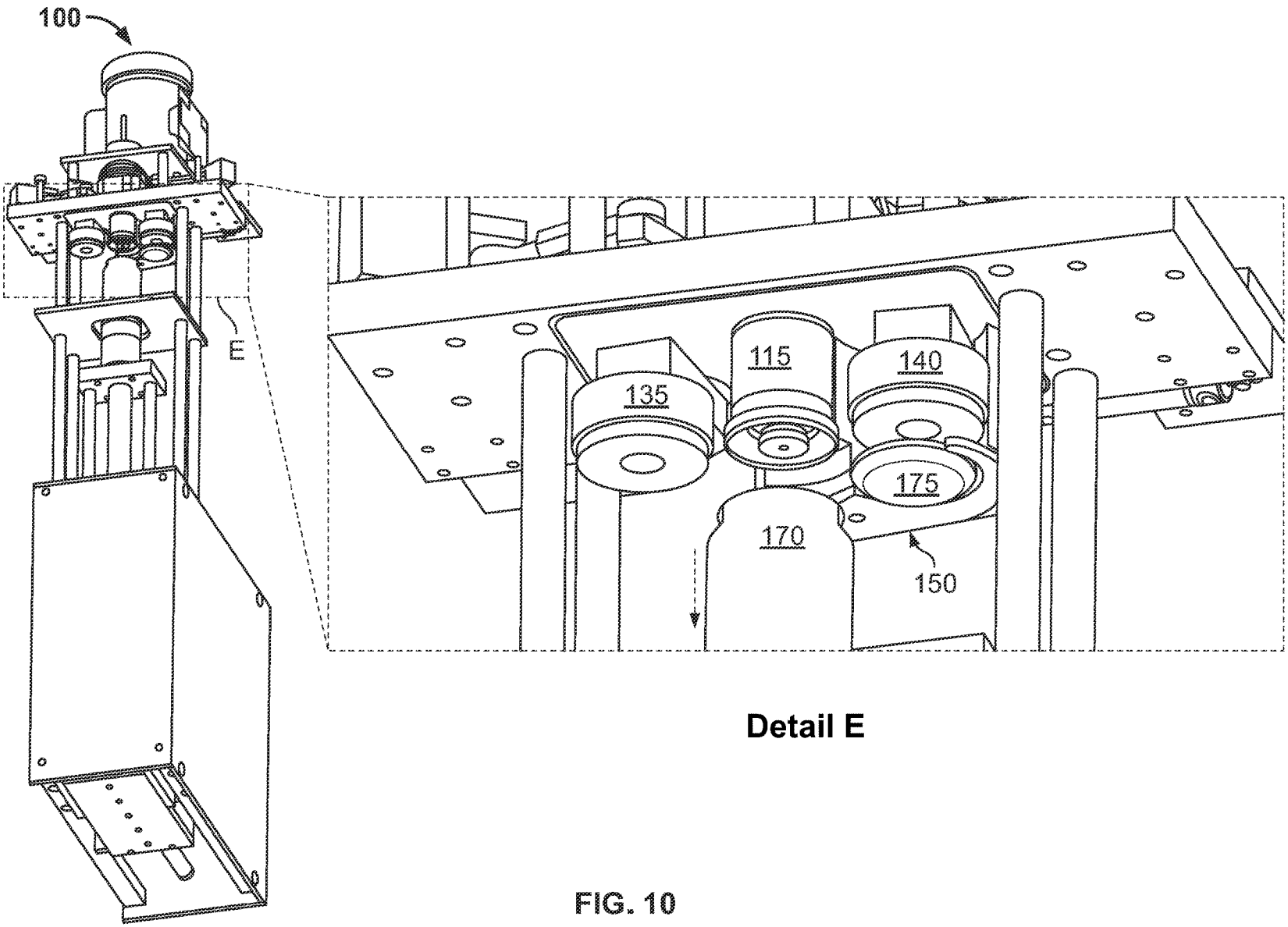
FIG. 10 illustrates vertical shifting of a beverage container during a filling process according to one embodiment.
Figure 11:
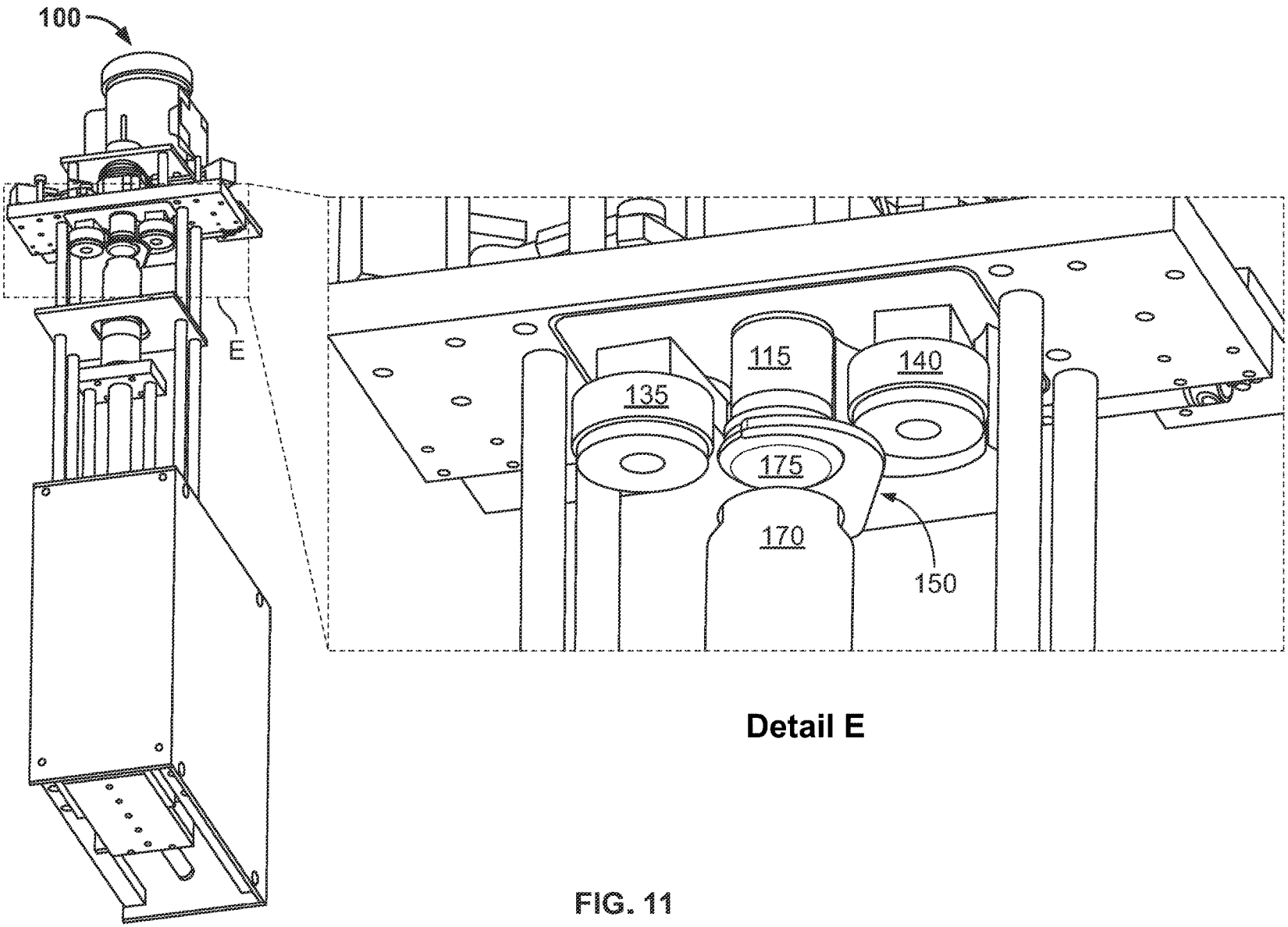
FIG. 11 illustrates swing arm and lid movement during a beverage container filling process according to one embodiment.

After the dispensing of the liquid contents is complete, platform 105 is shifted downward a distance suitable for swing arm 150 to return lid 175 back to the upper portion of the can, FIG. 10. Referring to FIG. 11, swing arm 150 now shifts so that lid 175 is aligned along a vertical axis with can 170 and filling head 115 as illustrated.

Figure 12:
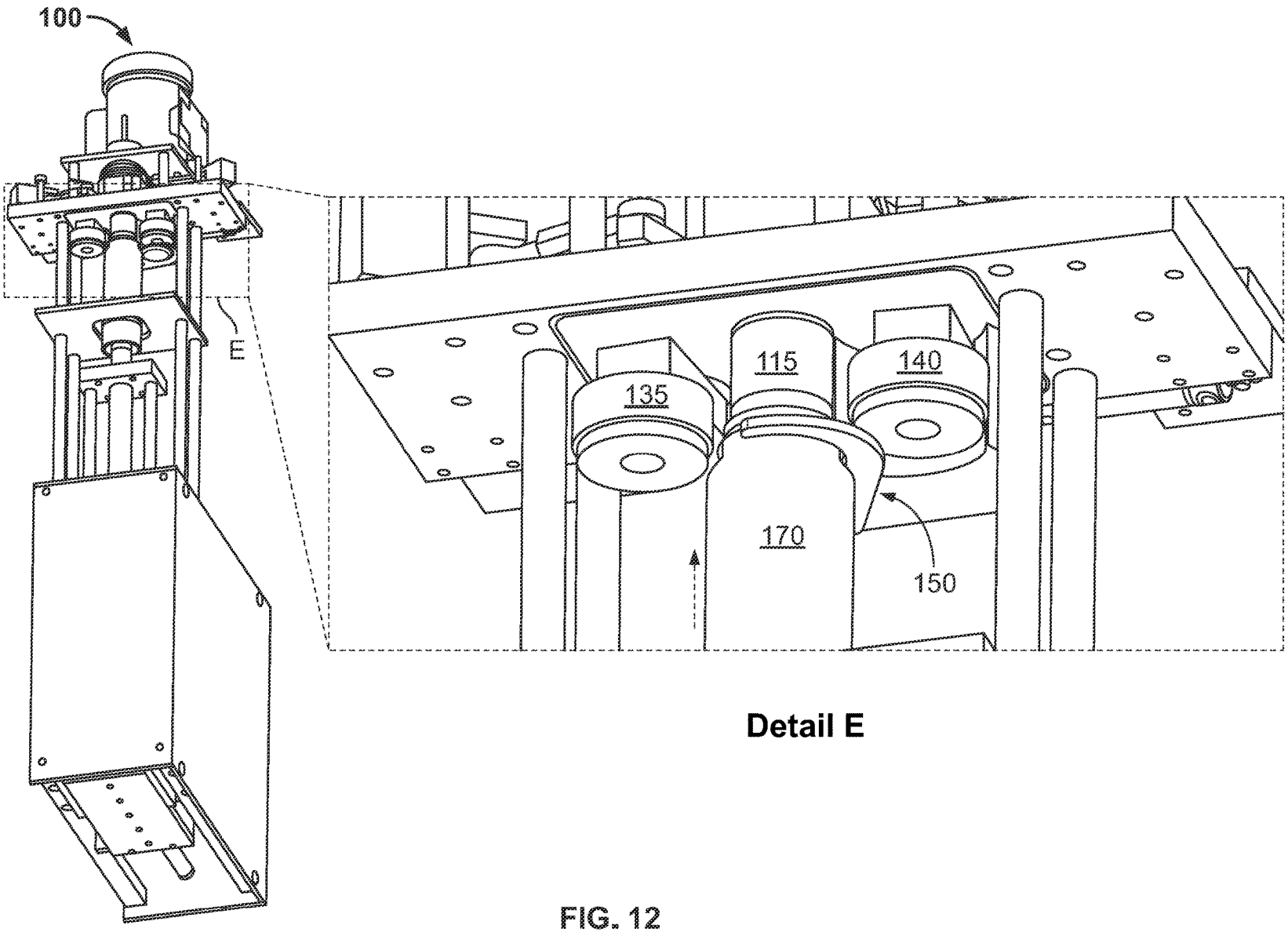
FIG. 12 illustrates vertical shifting of a beverage container during a beverage container filling process according to one embodiment.
Figure 13:
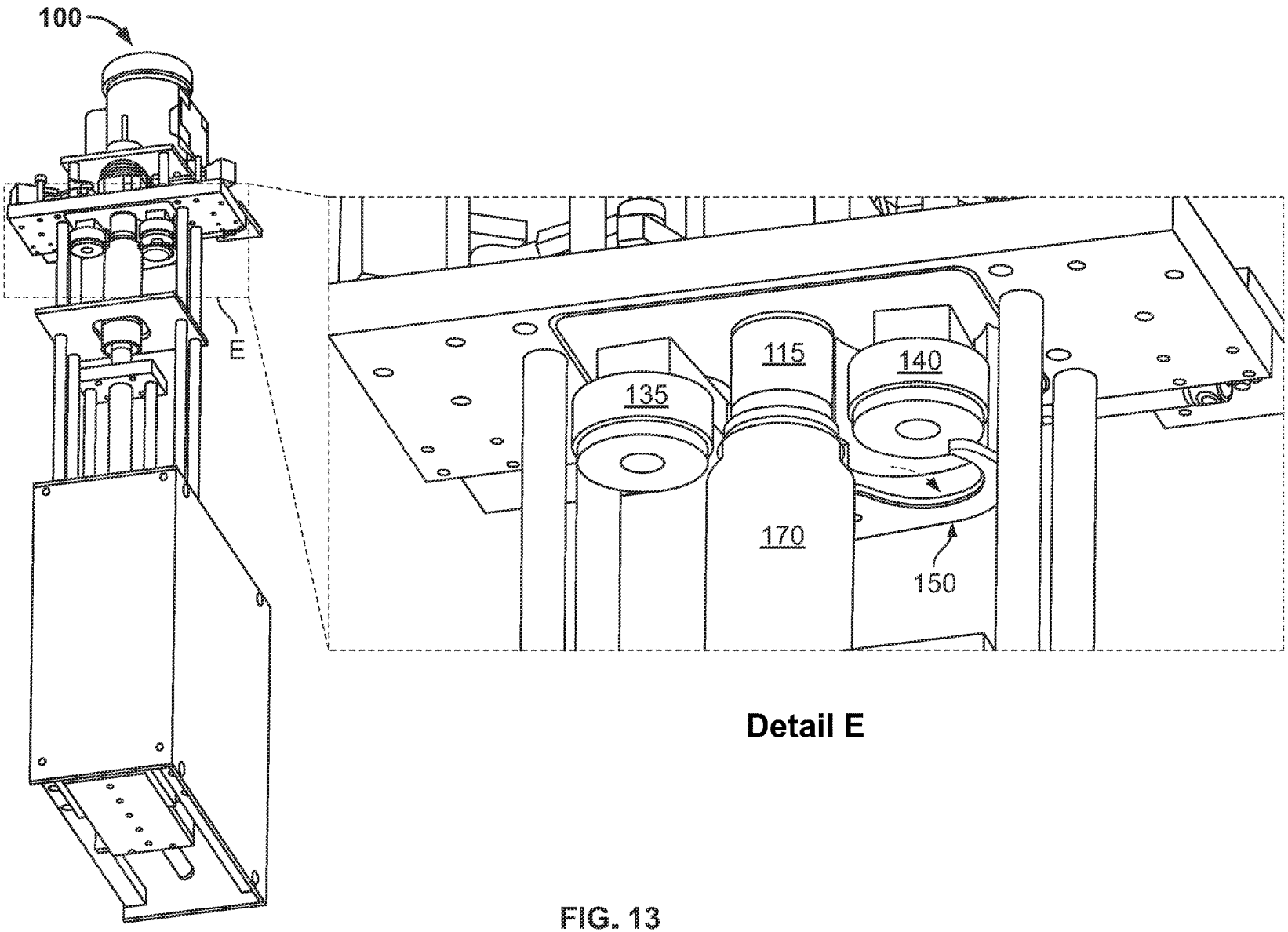
FIG. 13 illustrates swing arm motion away from a beverage container preceding a seaming process, according to one embodiment.

Next, referring to FIG. 12, platform 105 is shifted upward to urge the can 170 into the lid 175. Swing arm 150 subsequently reverses direction, to clear the can 170 and lid 175. Platform 105 then shifts further upward so that the lid 175 and the top of the can 170 can be engaged by seaming chuck 115.

Figure 14:
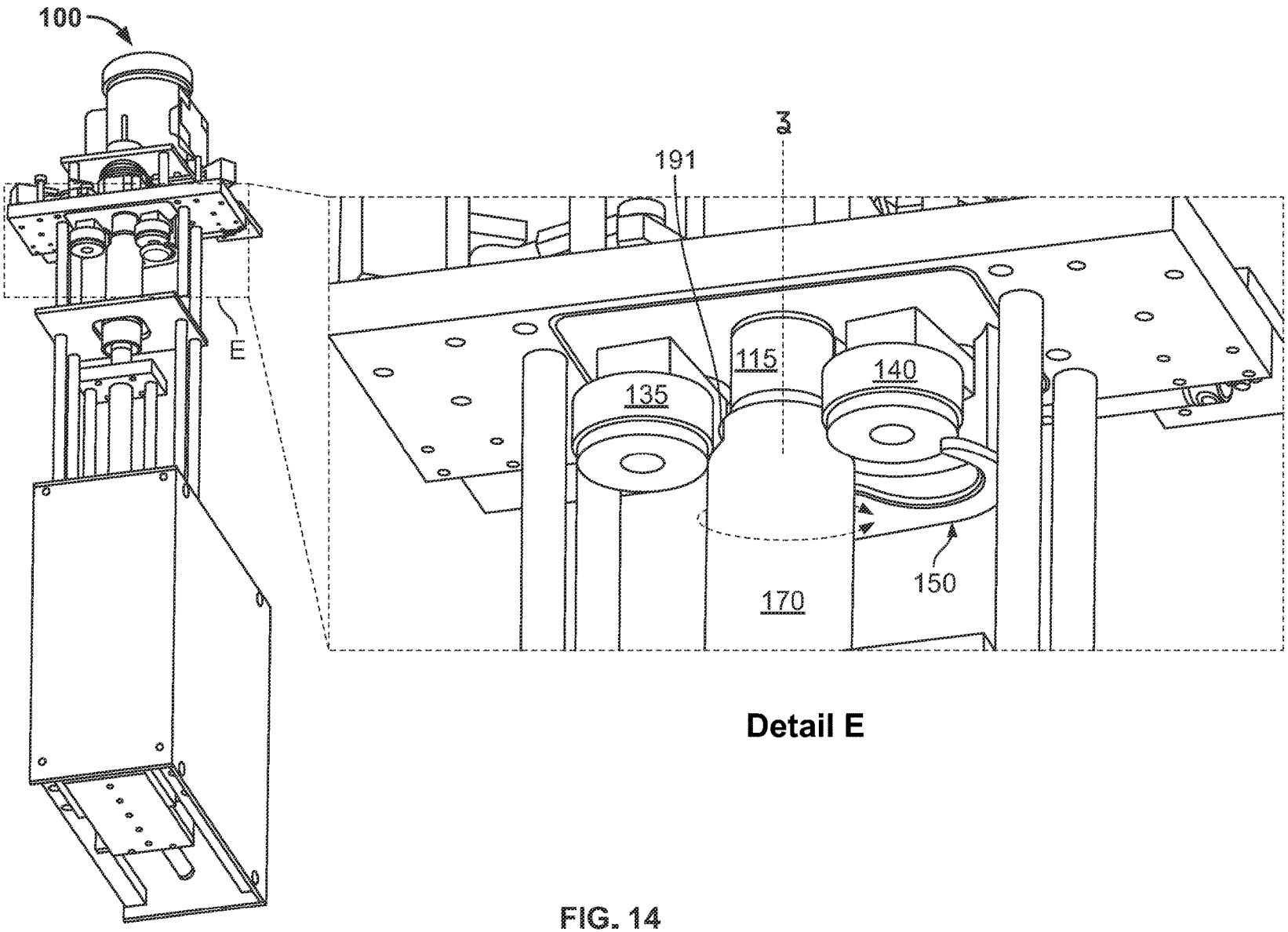
FIG. 14 illustrates a lid-to-can seaming process according to one embodiment.

Next, referring to FIG. 14, the can 170 and lid 175 are subjected to a double-seaming process to permanently affix the lid 175 to the can 170 body. In this embodiment, seaming chuck 115 is engendered to spin about a rotational axis illustrated by axis z, powered by motor 120. Platform 115 is configured to freely rotate about the same axis z; thus, seaming chuck 115, can 170, lid 175 and platform 115 are spun in the direction of the curved dashed arrow at a controlled rotational speed. Next, still referring to FIG. 14, one of the seaming rollers, in this example, seaming roller 140 is shifted toward seaming chuck 115 via seam roller controller assembly 130 so as to fold the edge of the can (commonly referred to as the flange) with a circumferential curl of the lid 175. This process joins the lid 175 and the can 170, but further strength can be required to permanently join the two pieces in an airtight configuration.

Figure 15:
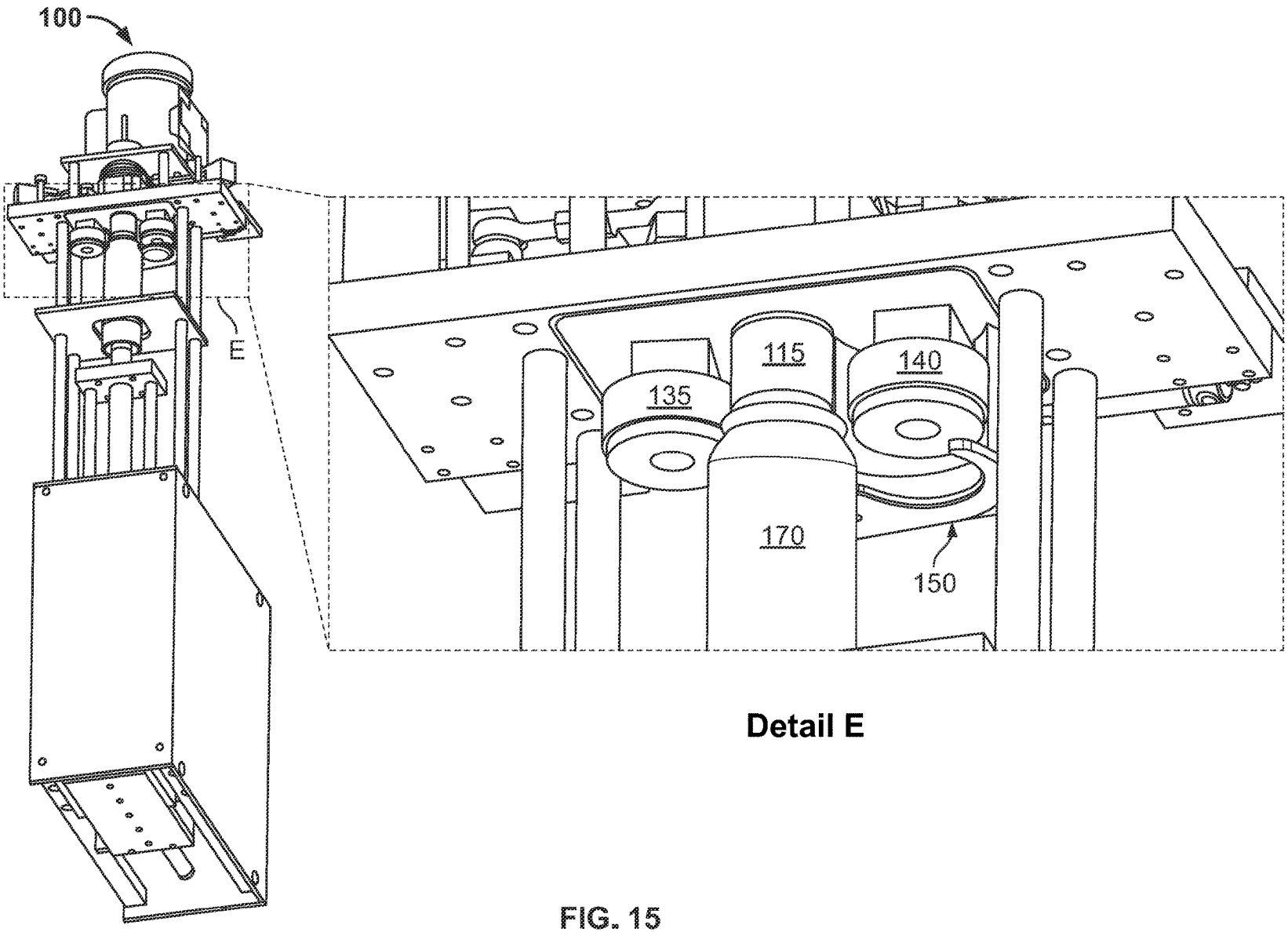
FIG. 15 illustrates a lid-to-can seaming process according to one embodiment.

Accordingly, referring to FIG. 15, when the first operation roll is completed, seaming roller 140 is translated back to its starting position and seaming roller 135 is translated via seam roller controller assembly 125 to engage the can 170 and lid 175 to complete the second operation roll. The second operation roll creates a tight fit between the can 170 and lid 175 that prevents the contents of the can from spilling out and likewise keeps the can pressurized.

Figure 16:
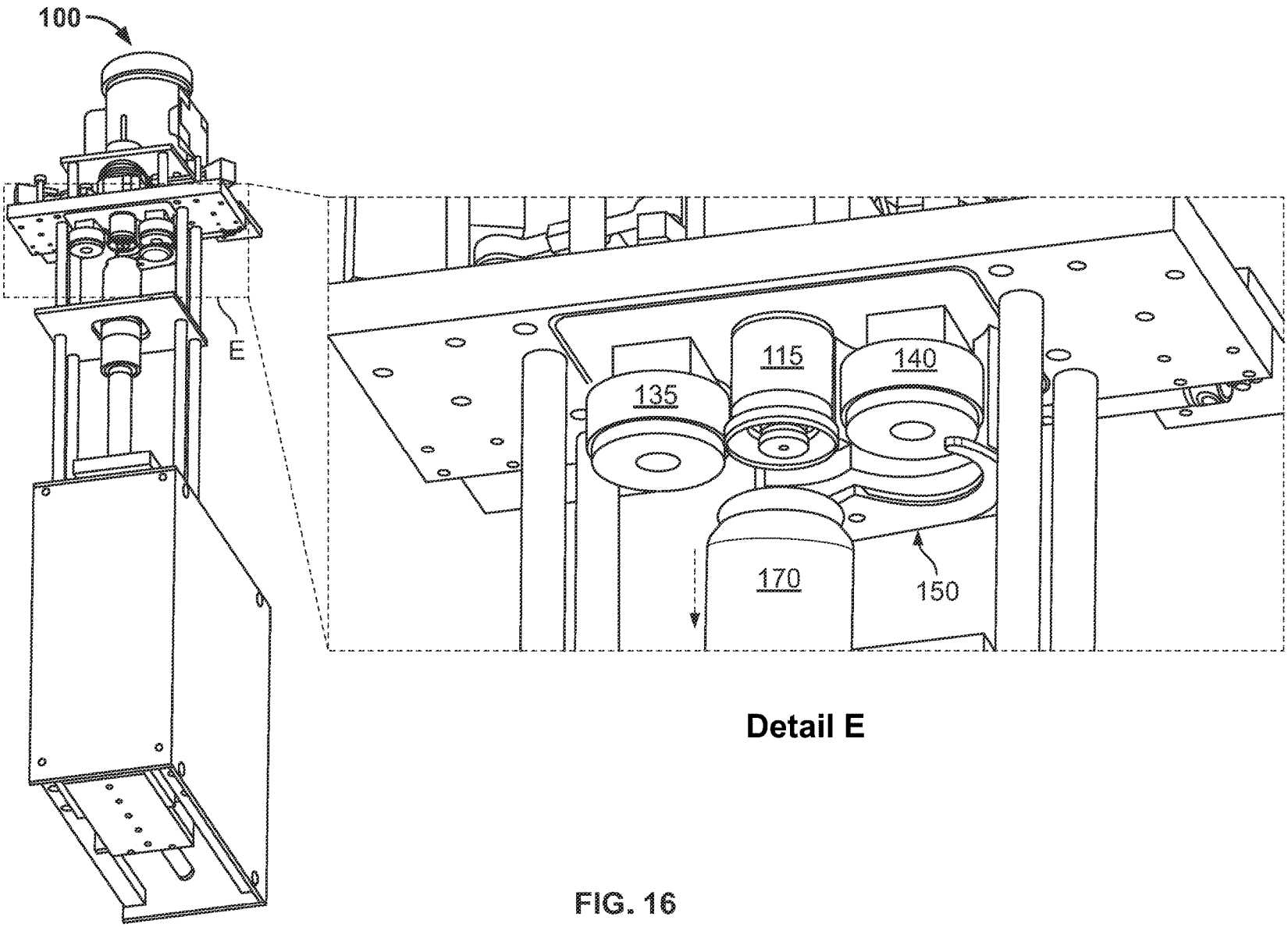
FIG. 16 illustrates vertical shifting of a filled beverage container having a lid sealed thereon in a seaming process according to one embodiment.

Lastly, referring to FIG. 16, platform 115 is translated downwardly, as illustrated by the dashed arrow. Cylinder 112 is subsequently or simultaneously shifted downward, so that the can 170 can be removed. The aforementioned process produces a canned beverage product that can be stored, packaged or processed as desired.

A number of illustrative embodiments have been described. Nevertheless, it will be understood that various modifications may be made without departing from the spirit and scope of the various embodiments presented herein. For example, the system 100 can be modified as desired to allow cans of any height, width or other dimension to be seamed with an appropriately-configured lid; furthermore, in an alternative embodiment, the system 100 can be modified to bottle contents using a bottle and bottle cap combination; in such an embodiment, seaming rollers 135, 140 may be excluded and seaming chuck 115 can be modified to be a bell-shaped bottle capper that crimps a cap around the bottle mouth as is known in the art; in such an embodiment, platform 115 can be configured to urge a bottle having a cap placed on the mouth into the bell-shaped seaming chuck to engender crimping of the cap around the bottle mouth. Accordingly, other embodiments are within the scope of the following claims.

What is claimed is:

1. A counter-pressure filler system, comprising:

a chamber having an entrance aperture, said chamber surrounding a seaming chuck and at least one seaming roller;

a vertically-translatable enclosure comprising an open upper rim configured to engage a portion of said chamber around said entrance aperture, thereby creating a shared, sealed environment within said vertically-translatable enclosure and said chamber; and a vertically-translatable platform configured to support a container thereupon that is disposed within said vertically-translatable enclosure; and a dispenser configured to dispense one or more ingredients into said container.

2. The counter-pressure filler system of claim 1, wherein said dispenser is configured to pass said one or more ingredients through said seaming chuck.

3. The counter-pressure filler system of claim 1, further comprising a vacuum source configured to evacuate said sealed environment.

4. The counter-pressure filler system of claim 1, wherein said sealed environment is configured to receive a gas or a gas mixture.

5. The counter-pressure filler system of claim 1, wherein said sealed environment is configured to be subjected to a negative atmospheric pressure followed by being subjected to a positive atmospheric pressure that introduces a gas or gas mixture to said sealed environment.

6. The counter-pressure filler system of claim 1, further comprising a swing arm configured to engage and controllably shift a lid, wherein said lid is configured to be seam-rolled onto said beverage container.

7. The counter-pressure filler system of claim 6, wherein said swing arm is configured to:

a) engage said lid;

b) shift said lid away from said beverage container prior to dispensing said ingredient; and c) shift said lid into a position to engage a top rim portion of said beverage container after said ingredient has been dispensed.

8. The counter-pressure filler system of claim 1, wherein said vertically-translatable platform is configured to rotate in a horizontal plane that is perpendicular to vertical translation.

9. The counter-pressure filler system of claim 1, wherein said seaming chuck and said seaming roller are configured to cooperatively seal a lid to said container.

10. The counter-pressure filler system of claim 9, wherein said container is an aluminum can and said lid is configured to be mated to a top portion of said aluminum can.

11. A method of counter-filling a beverage container, comprising:

placing an empty container atop a vertically-translatable platform, said empty container having an un-sealed lid resting thereupon;

translating said vertically-translatable platform such that said empty container is at least partially translated into an aperture of a chamber comprising a seaming chuck and a seaming roller; and translating a vertically-translatable enclosure such that a top portion of said enclosure sealingly engages said aperture so as to create a shared, sealed environment comprising an interior of said chamber and an interior of said enclosure;

wherein said enclosure encloses said vertically-translatable platform and said empty container.

12. The method of claim 11, further comprising evacuating said sealed environment by applying a vacuum.

13. The method of claim 12, further comprising adding a gas or a gas mixture to said sealed environment.

14. The method of claim 13, further comprising, after said gas or said gas mixture has been added to said sealed environment:

vertically translating said platform such that said lid is brought into proximity to a swing arm configured to engage said lid;

engaging said lid with said swing arm, followed by pivotally rotating said swing arm such that said lid is translated away from said container;

dispensing a quantity of liquid through said seaming chuck into said container;

after said dispensing step, pivotally rotating said swing arm such that said lid is brought into position to be seam rolled to said container.

15. The method of claim 14, further comprising:

vertically translating said platform such that said lid confronts said seaming chuck;

activating said seaming chuck to cause rotation of said container and said lid; and applying said seaming roller to said lid to cause a seam to be formed between said lid and said container.

16. The method of claim 11, wherein said liquid is carbonated.

17. The method of claim 11, wherein said container is an aluminum can.

18. The method of claim 11, wherein said vertically-translatable platform is configured to rotate in a horizontal plane, perpendicular to a vertical translation direction.

19. A counter-pressure filler, comprising:

a vertically-translatable platform configured to support a container;

a vertically-translatable enclosure configured to surround said platform, said enclosure comprising an open top portion;

a chamber comprising an entrance aperture, a seaming chuck and a seaming roller therewithin;

wherein said enclosure is configured to vertically translate to engage said chamber such that said open top surrounds said entrance aperture of said chamber, thereby creating a sealed filling environment comprising the interior of said chamber and said enclosure;

wherein the atmosphere of said filling environment can be evacuated and subsequently pressurized with a gas or a gas mixture; and wherein said seaming chuck comprises a through-aperture for dispensing liquid into said container.

20. The counter-filler of claim 19, wherein said vertically-translatable platform is rotatable about a horizontal axis.

* * * * *